US005358329A

United States Patent [19]

Plache et al.

[11] Patent Number: 5,358,329

[45] Date of Patent: Oct. 25, 1994

[54] APPARATUS FOR MIXING PLURAL FLOWABLE MATERIALS

[75] Inventors: Paul R. Plache, Boulder; Martin W. Selch, Niwot, both of Colo.

[73] Assignee: Fluid Dynamics, Inc., Boulder, Colo.

[21] Appl. No.: 17,513

[22] Filed: Feb. 12, 1993

[51] Int. Cl.[5] ..... B01F 5/12

[52] U.S. Cl. ..... 366/97; 366/75; 366/307; 366/76; 366/99; 366/315

[58] Field of Search ..... 366/97, 75, 91, 263, 366/293, 305, 307, 52, 69, 136, 262, 315, 607; 72/262

[56] References Cited

U.S. PATENT DOCUMENTS

| | | | |
|---|---|---|---|
| 3,248,755 | 5/1966 | Plymale | 18/12 |
| 3,831,907 | 8/1974 | Claes | 259/7 |
| 3,925,243 | 12/1975 | Brogli et al. | 252/359 C |
| 3,934,859 | 1/1976 | Deve | 259/8 |
| 4,194,841 | 3/1980 | Tadmor | 366/97 X |
| 4,255,059 | 3/1981 | Hold et al. | 366/97 |
| 4,289,319 | 9/1981 | Hold et al. | 366/97 X |
| 4,329,065 | 5/1982 | Hold et al. | 366/97 |
| 4,711,581 | 12/1987 | Mehta et al. | 366/99 |
| 4,834,545 | 5/1989 | Inoue et al. | 366/138 |
| 5,018,871 | 5/1991 | Brazelton et al. | 366/168 |
| 5,061,456 | 10/1991 | Brazelton et al. | 422/134 |

*Primary Examiner*—David A. Scherbel
*Assistant Examiner*—Patrick F. Brinson
*Attorney, Agent, or Firm*—Harold A. Burdick

[57] ABSTRACT

An apparatus for mixing plural flowable materials, for example liquids, is disclosed having a disk-shaped rotor connected to a rotating drive shaft and housed in a cylindrical chamber. The rotor has engraved on one or both faces a spiral-shaped groove to provide sufficient mixing turbulence and prevent unmixed solute from exiting the chamber. The chamber is defined by walls of two stationary end plates separated by an outer cylindrical barrel. When configured in multiple stages having a plurality of rotors connected with a single rotating drive shaft and housed in a plurality of axially arranged such chambers, a centrally-drilled passage intervening between chambers connects adjacent chambers. Additional solvent liquid is introduced at each mixing stage through a radially drilled passage. The materials to be mixed are confined to a narrow interstice between the rotor, adjacent walls and barrel, and pass in sequence from one chamber to the next.

20 Claims, 6 Drawing Sheets

APPARATUS FOR MIXING PLURAL FLOWABLE MATERIALS

FIELD OF THE INVENTION

This invention relates to mixing apparatus, and, more particularly, relates to apparatus for mixing two or more flowable materials.

BACKGROUND OF THE INVENTION

Mixing devices for dilution and blending of materials have been heretofore suggested and/or utilized (see U.S. Pat. Nos. 4,834,545, 3,934,859, 3,925,243, and 3,831,907). More specifically, such devices for mixing viscous liquid polymeric material and water have been heretofore suggested and/or utilized (see U.S. Pat. Nos. 5,018,871 and 5,061,456).

Because long-chain polymers (such as solution-type, or mannich, viscous liquid polyelectrolytes) have high molecular weight and viscosity, proper dilution requires turbulence and fluid shear. Excessive shear, however, can break the polymer chains and render the polymer ineffective, while insufficient shear results in unblended polymer and a non-homogeneous solution. Therefore, when blending such liquids as polymer and water, it is desirable to have the ability to control the type and amount of mixing energy applied to the polymer.

Heretofore known mixing, or blending, devices have not always proved effective for diluting and activating such solution-type polymers. Devices utilizing impellers for such blending operations can damage the polymer with excessive shear caused by rotating impeller edges. While a homogeneous solution may thus be produced, the numerous broken polymer chains exhibited can make the solution substantially less capable of serving its intended purpose (for example as a flocculant or dewatering agent). Other devices fail to optimize shear and/or blending duration, often resulting in non-homogeneous, and thus less effective, solution of polymer and solvent (such as water) in which only a smaller than desirable percentage of polymer has been diluted (leaving the remainder in clumps or fisheyes).

Thus, an improved mixing device which can apply enough mixing shear to properly disperse the polymer molecules in the solvent liquid while refraining from breaking the polymer chains and rendering them less useful could still be utilized.

SUMMARY OF THE INVENTION

This invention provides an apparatus for mixing plural flowable materials, and particularly for mixing materials such as long-chain polymeric materials or the like and a solvent (for example, water), which enables greater uniformity and control of intensity and duration of mixing energy, including provision of adequate shear to properly dilute and mix the materials while refraining from damaging more shear sensitive, long-chain molecules. Flow of materials being mixed is constrained to a defined flow path thus assuring no inadvertent and undesired bypassing of exposure to intended turbulent environments in the apparatus of unmixed materials.

The mixing apparatus is, more specifically, designed to dilute, blend, and thus activate, viscous liquid polymeric material, such as solution-type (or mannich) liquid polyelectrolytes, in a highly turbulent environment created primarily in an interstice between members in relative rotary motion. This turbulence is sufficient to separate individual polymer molecules from each other and provide opportunities for polymer adsorption on the diluent, but insufficient to break the polymer molecules themselves.

The apparatus includes a rotatable member having a selected surface complexity defined at at least one material contacting surface thereof. A drive assembly is connected with the rotatable member, the rotatable member being mounted in a housing defining a chamber. A static member is positioned at the housing so that an interstice is defined between the static member and the material contacting surface of the rotatable member. An inlet (or a plurality thereof) introduces flowable materials at the interstice between the static member and the material contacting surface of the rotatable member, and an outlet accommodates flow of mixed flowable materials from the chamber.

The chamber includes first and second spaced chamber walls and a peripheral wall having a selected length defined between the first and second chamber walls adjacent to an outer part of the first and second chamber walls. The first chamber wall has an inlet at a central part thereof, and the second chamber wall has the outlet adjacent to a central part thereof.

The rotatable member is mounted for rotation between the first and second chamber walls, and has a width marginally smaller than the length of the peripheral wall of the chamber so that first and second interstices are defined between a first material contacting surface of the rotatable member and the first chamber wall and a second material contacting surface of the rotatable member and the second chamber wall, respectively, the interstices being in communication through a passage defined between the peripheral wall and an outer edge of the rotatable member.

The apparatus may have multiple adjacent chambers, as heretofore summarized, with a plurality of rotatable members each mounted in a different one of the chambers.

It is therefore an object of this invention to provide an improved apparatus for mixing flowable materials.

It is another object of this invention to provide an apparatus for mixing flowable materials particularly adapted for use in dilution and blending of shear sensitive polymeric materials.

It is still another object of this invention to provide an apparatus for mixing flowable materials which enables greater uniformity and control of intensity and duration of mixing energy, including provision of adequate shear to mix the materials while refraining from damaging more shear sensitive materials.

It is yet another object of this invention to provide a mixing apparatus wherein materials being mixed are constrained to a defined flow path to assure exposure of the materials to the turbulent environments created in the apparatus.

It is still another object of this invention to provide a mixing apparatus which creates a turbulent environment primarily in an interstice between members in relative rotary motion.

It is still another object of this invention to provide an apparatus for mixing plural flowable materials which includes a rotatable member having a selected surface complexity defined at at least one material contacting surface thereof, driving means connected with the rotatable member, a housing defining a chamber having the rotatable member rotatably mounted therein and including a static member positioned so that an interstice is defined between the static member and the material contacting surface of the rotatable member, an inlet through the housing for introducing flowable materials at the interstice between the static member and the material contacting surface of the rotatable member, and an outlet connected to the housing for accommodating flow of mixed flowable materials from the chamber.

It is yet another object of this invention to provide an apparatus for mixing plural flowable materials which includes a housing defining a chamber having first and second spaced chamber walls and a peripheral wall having a selected length defined between the first and second chamber walls adjacent to an outer part of the first and second chamber walls, the first chamber wall having inlet means at a central part thereof for introducing flowable materials into the chamber, and the second chamber wall having an outlet adjacent to a central part thereof for accommodating flow of flowable materials from the chamber, a rotatable shaft mounted through the chamber, and a rotatable member mounted on the shaft and in the chamber for rotation between the first and second chamber walls thereof, the rotatable member having first and second material contacting surfaces and a width between the surfaces marginally smaller than the length of the peripheral wall of the chamber so that first and second interstices are defined between the first surface and the first chamber wall and the second surface and the second chamber wall, respectively, the interstices being in communication through a passage defined between the peripheral wall and an outer edge of the rotatable member.

It is yet another object of this invention to provide an apparatus for mixing plural flowable materials including a housing defining multiple adjacent chambers, each chamber being defined by first and second spaced chamber walls and a peripheral wall having a selected length defined between the first and second chamber walls, an inlet for introducing flowable materials into the related chamber, and an outlet for accommodating flow of flowable materials from the related chamber, a plurality of rotatable members each mounted in a different one of the chambers for rotation between the first and second chamber walls thereof, the rotatable members each having a width between said first and second surfaces marginally smaller than the length of the peripheral wall of the chamber in which a rotatable member is mounted so that first and second interstices are defined between the first surface and the first chamber wall and the second surface and the second chamber wall, respectively, in each chamber, the first and second interstices being in communication in each chamber through a passage defined between the peripheral wall and an outer edge of the rotatable member in each said chamber, and driving means connected with the rotatable members.

With these and other objects in view, which will become apparent to one skilled in the art as the description proceeds, this invention resides in the novel construction, combination and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

The mixing apparatus of this invention, as illustrated in FIGS. 1 through 11, is configured to provide a plurality of mixing stages, each being similar in many regards to the others, the number of mixing stages being variable, for example depending on application, it being understood that the apparatus of this invention may reside in a single or multiple stages.

Figure 1:
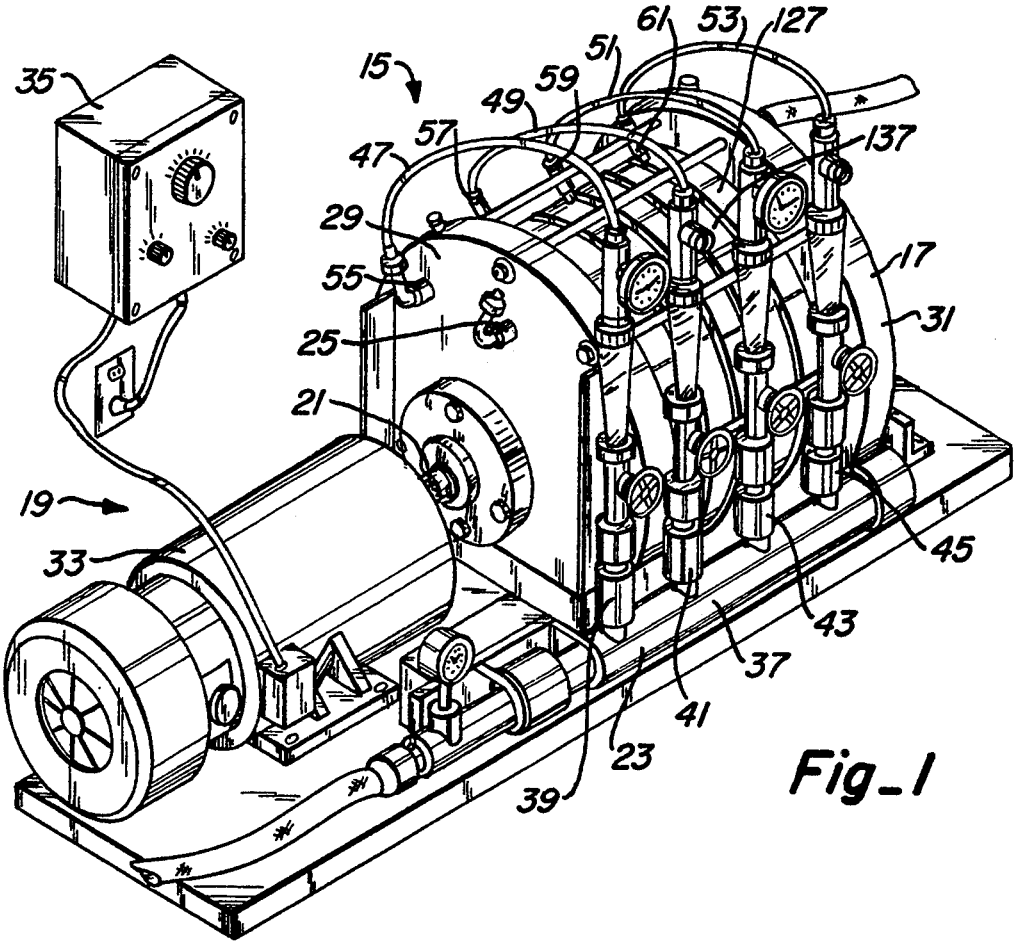
FIG. 1 is a perspective view of the apparatus of this invention.
Figure 2:
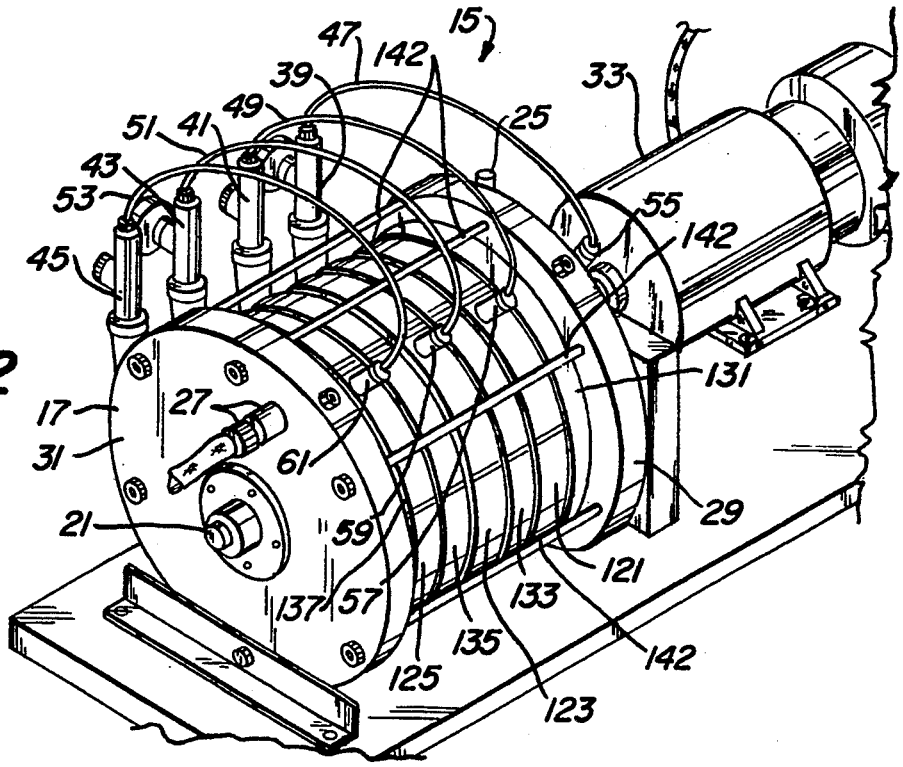
FIG. 2 is a reverse partial perspective view of the apparatus of FIG. 1.

Mixing apparatus 15 shown in FIGS. 1 and 2 includes mixer housing 17, variable speed drive assembly 19 connected with driving shaft 21, first flowable material delivery assembly 23, second flowable material intake 25, and outlet 27. Housing 17 includes end plate members 29 and 31, and drive assembly 19 includes drive motor 33 and variable speed control 35.

Material delivery assembly 23 (for example, providing a diluting solvent such as water) includes supply conduit 37 connectable with a source of the material, and valved and metered stage delivery conduits 39, 41, 43 and 45 connected with supply conduit 37 and having connector lines 47, 49, 51 and 53, respectively, connected to intakes 55, 57, 59 and 61, respectively, at housing 17.

Figure 3:
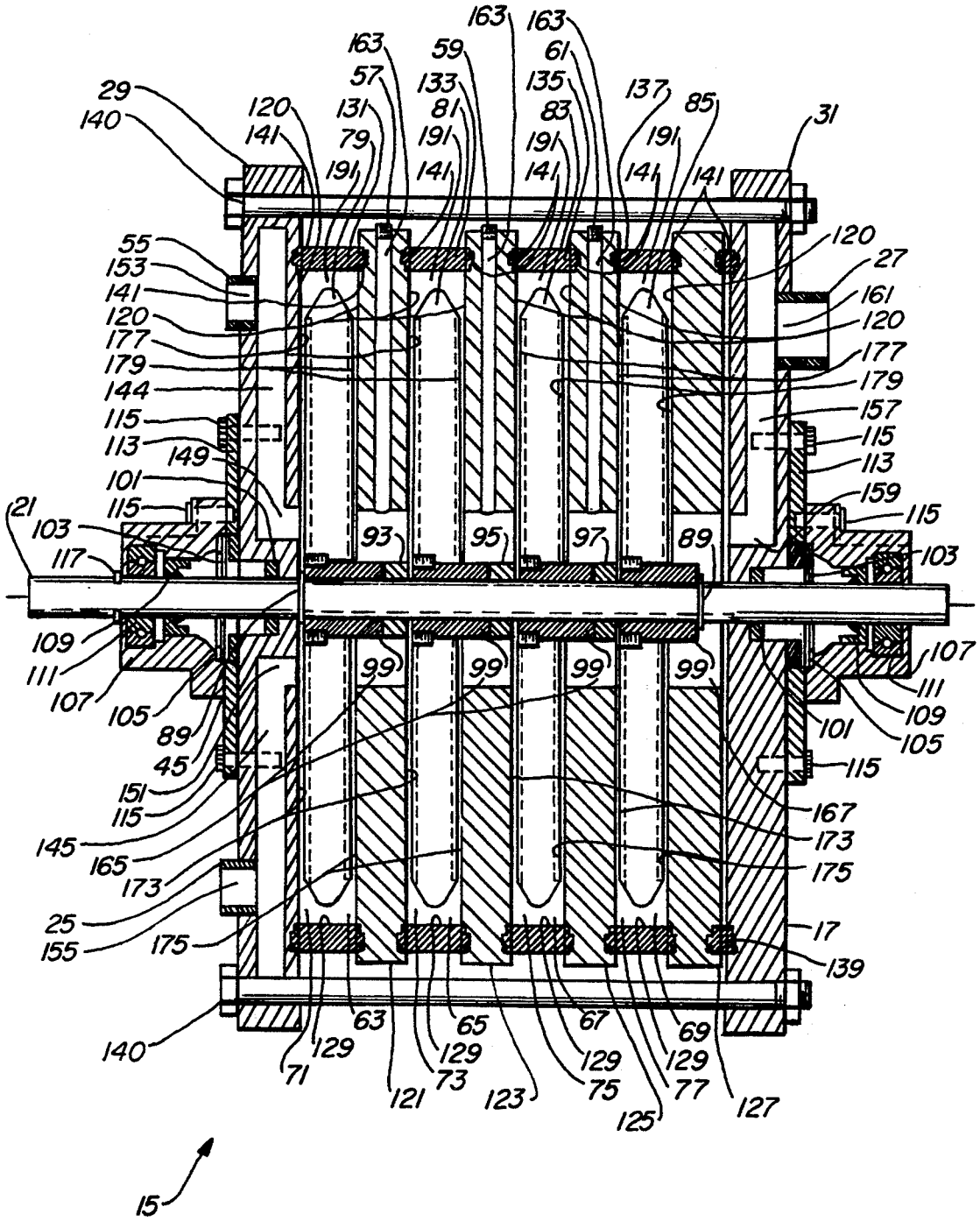
FIG. 3 is a sectional illustration of the apparatus of this invention.
Figure 10:
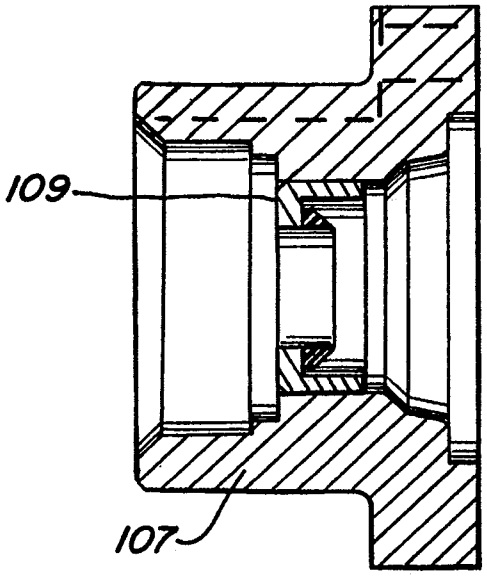
FIG. 10 is a sectional illustration of the shaft bearing housing of the apparatus of this invention.
Figure 11:
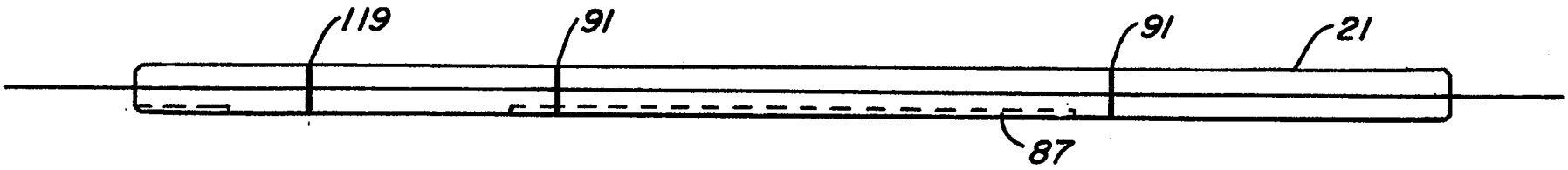
FIG. 11 is a side view of the rotatable shaft of the apparatus of this invention.

Apparatus 15 as illustrated in FIG. 3 employs four mixing stages 63, 65, 67 and 69 generally defined by cylindrical chambers 71, 73, 75 and 77 of housing 17. Disc shaped rotatable members (hereinafter called rotors) 79, 81, 83 and 85 are mounted and keyed (at 87 in FIG. 11) to shaft 21 and retained axially by retaining rings 89 anchored in grooves 91 (FIG. 11) cut in shaft 21, and by spacers 93, 95, 97 adjacent to bushings 99 of rotors 79, 81 and 83. While disc shaped rotors and cylindrical chambers are shown it should be recognized that other geometries could be utilized (for example, rotors having concave or convex material contacting surfaces with chamber walls milled accordingly to provide closely adjacent surfaces providing an interstice as shown and described hereinbelow in more detail). Since all four rotors are mounted on shaft 21, the rotors all rotate at a single, adjustable speed as controlled by speed control 35.

Where shaft 21 passes through the end plates 29 and 31, packing seals 101, compressed by packing rings 103 and spring washers 105, are provided to limit leakage of the materials from mixing chambers 71 and 77 into bearing housings 107 (also shown in FIG. 10). Bearing housings 107 provide opposing force to compress spring washers 105 against packing rings 103. Lip seals 109 isolate bearings 111 from any material which may pass packing seals 101. Bearing housings 107 are mounted on cover plates 113 and thus to end plates 29 and 31 (using, for example, machine screws 115), thus locating shaft 21 radially, shaft 21 being located axially by retainer ring 117 mounted in groove 119 in shaft 21 (as also shown in FIG. 11).

Mixing chambers 71, 73, 75 and 77 are defined by inner walls 120 of static members including end plate 29, stator members 121, 123, and 125, and inner end plate 127, and peripheral inner walls 129 of barrel sections 131, 133, 135 and 137. Barrel sections 131, 133, 135 and 137 and barrel section 139 are variously retained in annular grooves 141 in the outer part of stator members 121, 123, and 125 and end plates 29, 31 and 127 (as shown with respect to stator member 121 in FIG. 6). Concentric with each groove 141 (of larger annular area) is annular groove 142 having a smaller cross-section and into which is seated o-ring seal 143. The entire housing 17 is secured by rods 140 secured between end plates 29 and 31. Each barrel is thus compressed between an endplate and stator member, or between two stator members, such that o-ring seals 143 provide a fluid-tight seal.

Figure 9:
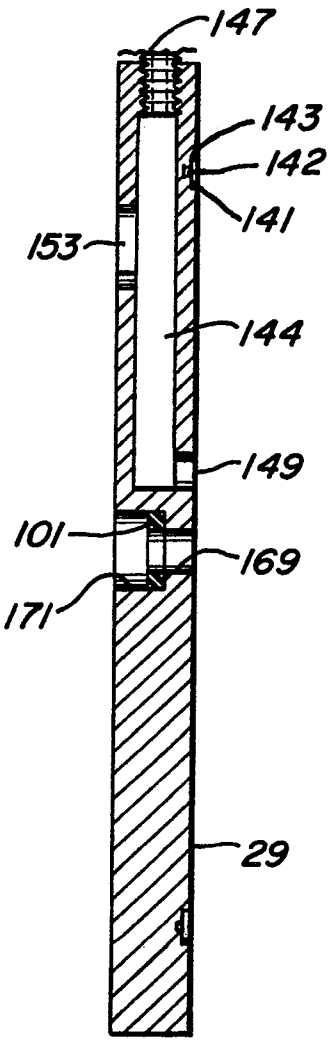
FIG. 9 is a sectional view taken through section line 9—9 of FIG. 8.
Figure 8:
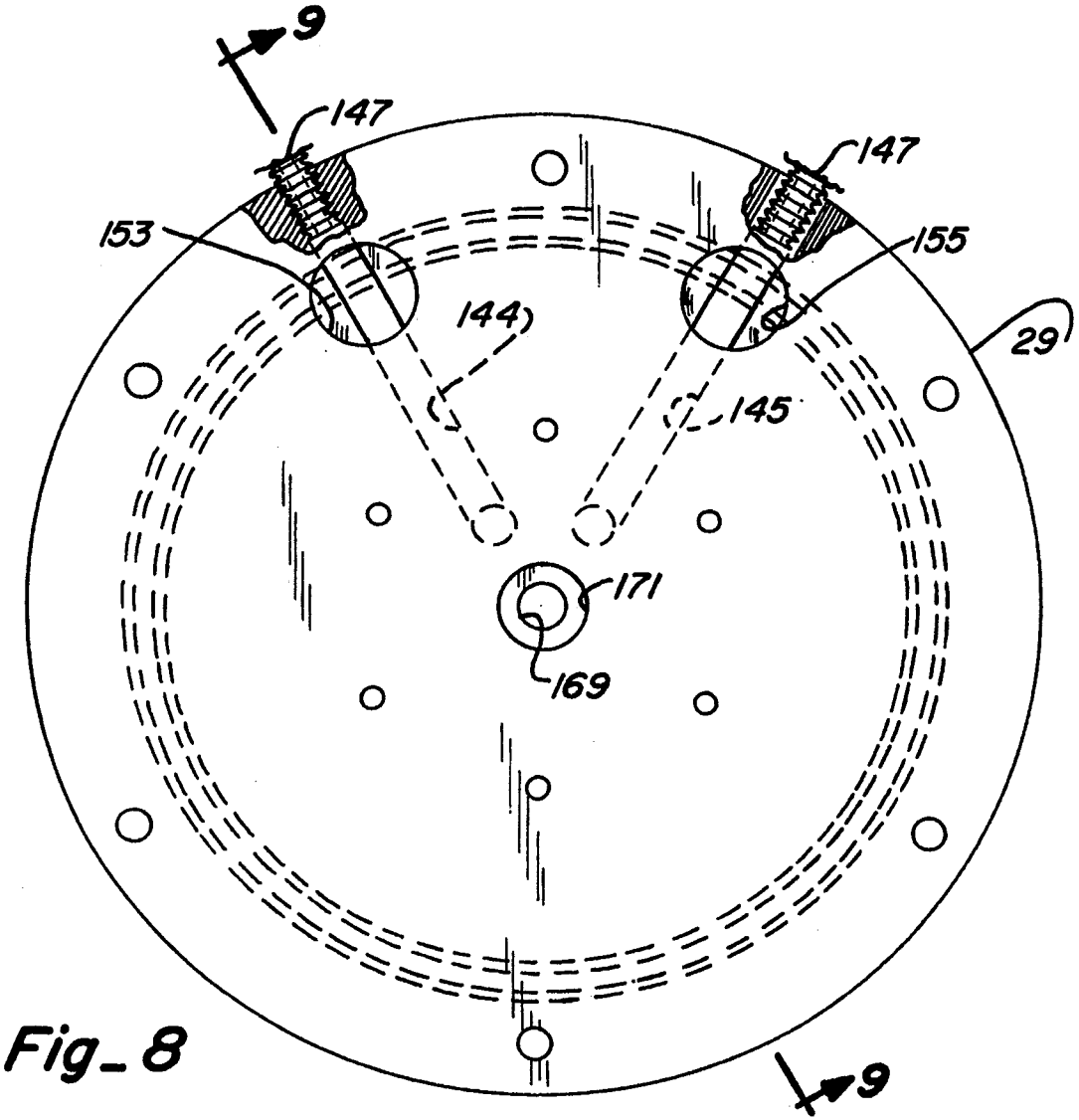
FIG. 8 is a front view of an end plate of the apparatus of this invention.

Passages 144 and 145 are drilled radially through end plate 29 (as also shown in FIGS. 8 and 9) and sealed at the outer radius with plugs 147 to provide separate passages for materials to be mixed (such as polymer through passage 145 and water through passage 144). Input passages 149 and 151 through wall 120 of end plate 29 and intake passages 153 and 155 complete the passage formed for introducing the flowable materials into chamber 71. Similarly, passage 157 is radially drilled through end plate 31 and connects with outlet passages 159 and 161 to accommodate flow of mixed materials from chamber 77.

Figure 7:
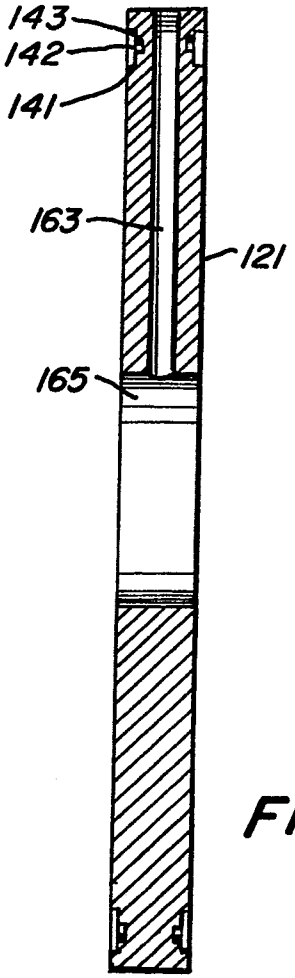
FIG. 7 is a sectional view taken through section line 7—7 of FIG. 6.
Figure 6:
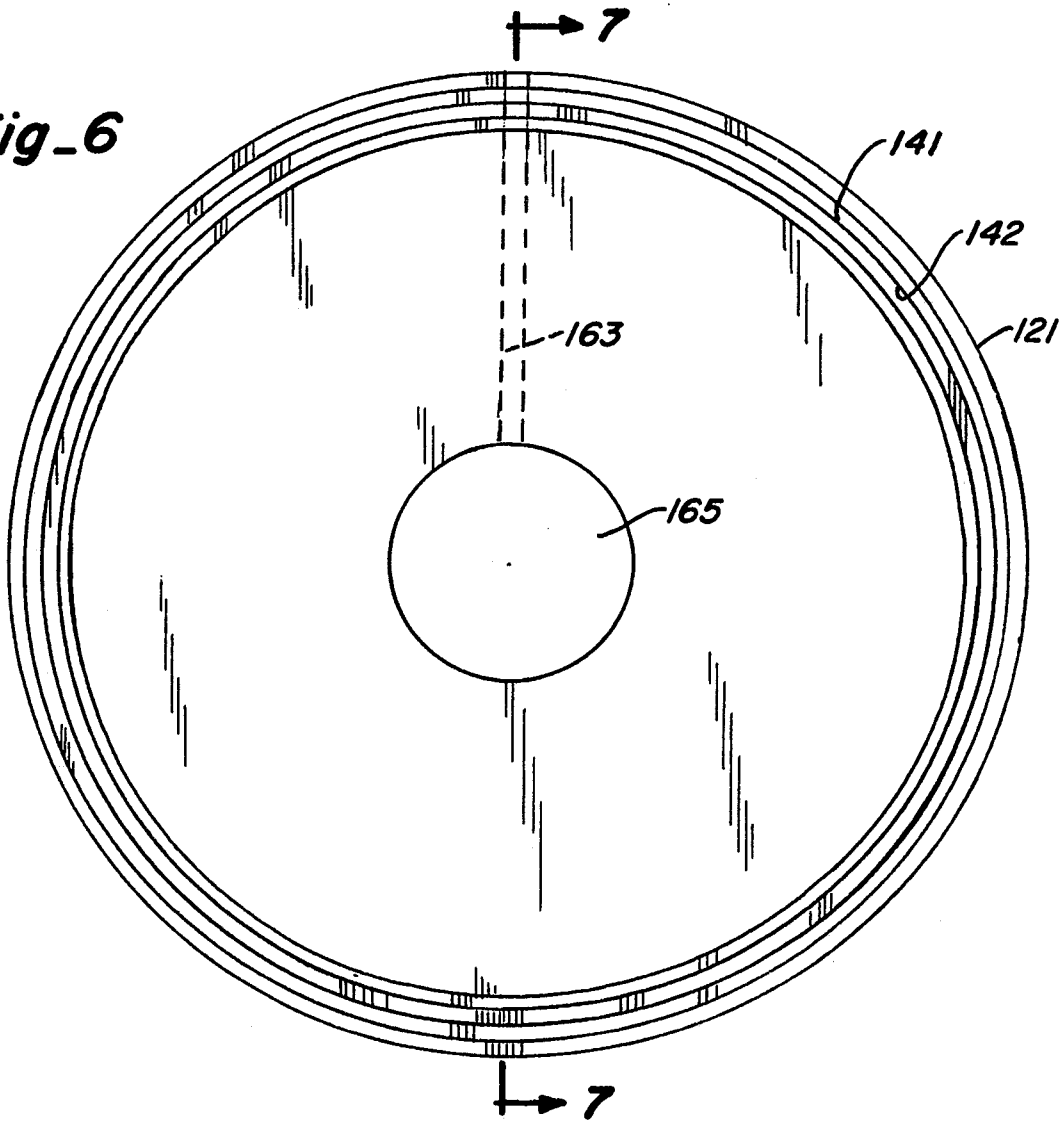
FIG. 6 is a front view of a stator used in forming the chambers of the apparatus of this invention.

As illustrated in FIGS. 3, 6 and 7, each of stator members 121, 123 and 125 has additional material input passages 163 radially bored therein for introduction into each of chambers 73, 75 and 77 of additional material (for example water) through passages 165 which also accommodate shaft 21 (inner end plate member likewise is provided with an outlet passage 167 to accommodate shaft 21 and passage of mixed materials from chamber 77 to outlet passage 159). Passages 163 might also be positioned through barrel sections 131, 133, 135 and/or 137 for direct introduction of the additional flowable materials into the chambers. Housing 17 is preferably constructed of PVC and has intakes 25, 55, 57, 59 and 61 and outlet 27 (standard NPT fittings, for example) welded into their respective passages.

As shown in FIGS. 8 and 9 with respect to end plate 29, hole 169 is drilled through the center of plates 29 and 31 allowing shaft 21 to pass therethrough. Concentric with hole 169, on the outer side of plates 29 and 31, is a counter-sunk bore 171 in which rests packing seal 101.

While not illustrated, it is to be understood that each successive cylindrical barrel section, beginning with the smallest at stage 63, is slightly longer than the previous one, causing interstices 173 and 175 between material contacting surfaces 177 and 179 of each rotor and walls 120 of each successive chamber to increase in area and thus flow capacity at each stage to thus allow for the increasing material flow in each successive mixing stage (alternatively the width of each successive rotor could be smaller).

Rotors 79, 81, 83 and 85 are each inscribed with a selected surface complexity on at least one, and preferably both, of material contacting surfaces 177 and 179. While any of a variety of such surface complexities characterized by surface portions of the material contacting surface having different relative elevations at a common boundary area of the surface portions could be utilized, spiral channel, or groove, 181 as shown in FIGS. 4 and 5 is preferred.

In one tested embodiment, spiral groove 181 is approximately one-eigth inch wide by one-eigth inch deep, is hemispherical at the bottom of the groove and has rounded edges at each top edge of the groove (adjoining the adjacent surface). Each groove segment (one complete turn of the spiral) 183 of spiral groove 181 is spaced from the adjacent groove segments by about one-half inch (at outer segments). Each spiral groove in each material contacting surface of rotors 79, 81, 83 and 85 begins adjacent to central bore 185 and radiates outwardly terminating at beveled edge 187 of the rotors.

Figure 5:
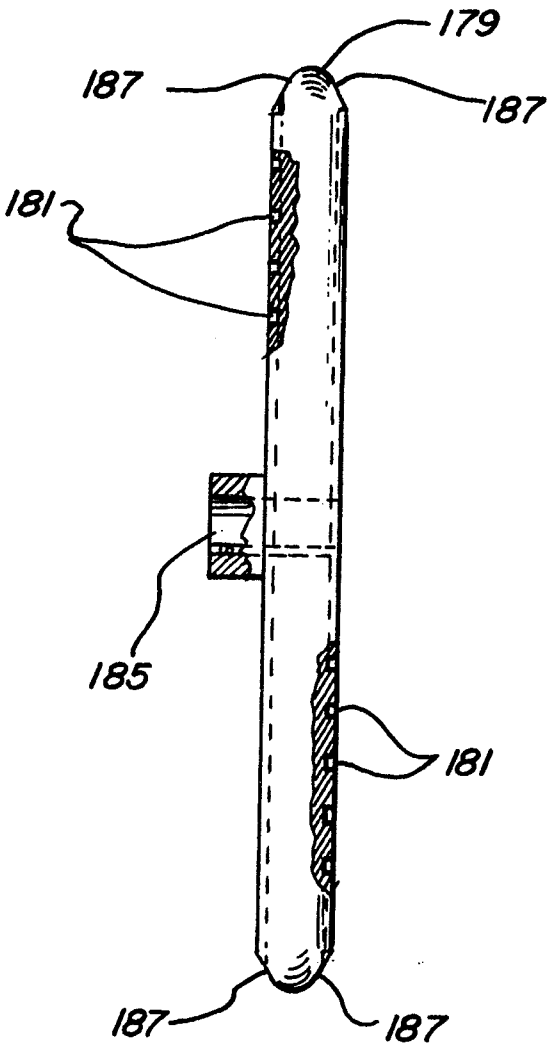
FIG. 5 is a side view of the rotor of FIG. 4.
Figure 4:
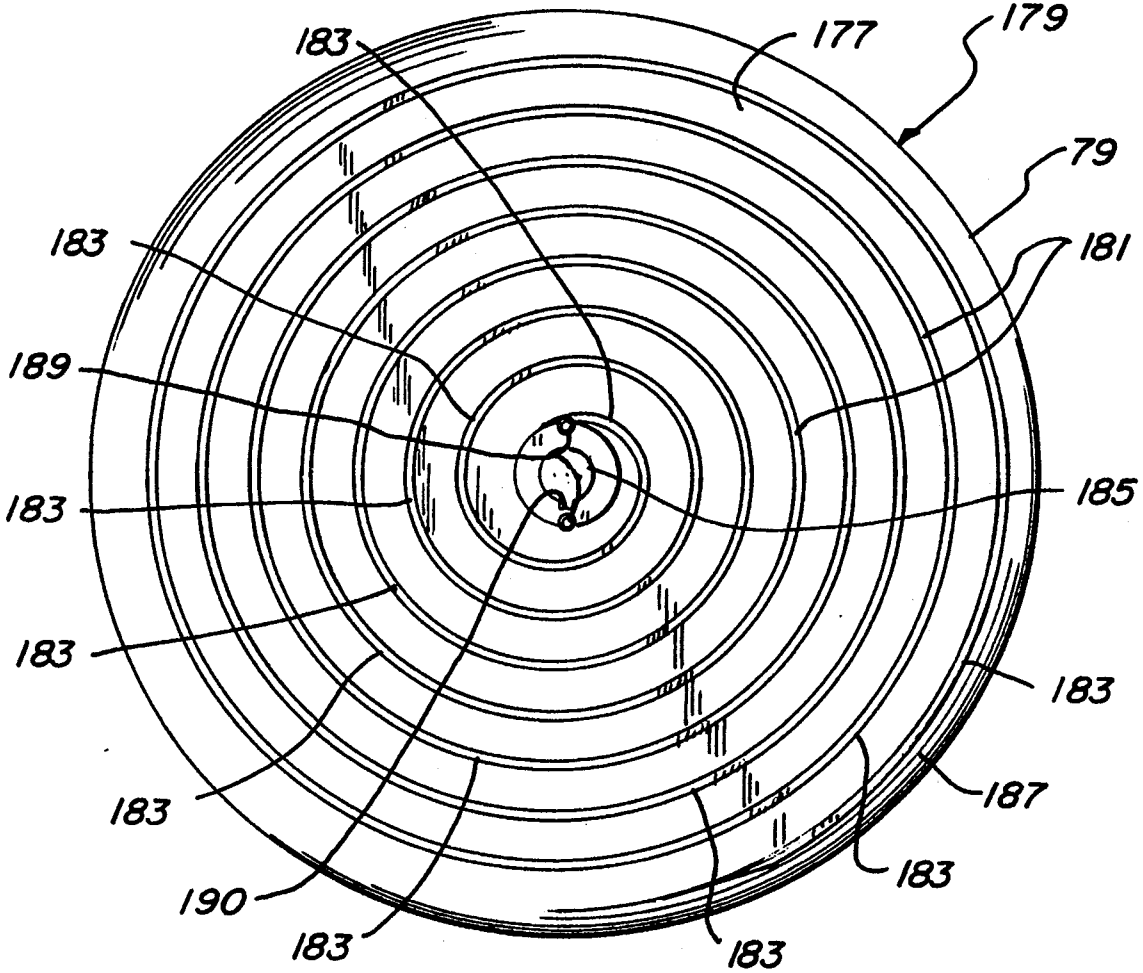
FIG. 4 is an illustration of a rotor used in the apparatus of FIGS. 1 through 3.

As shown in FIGS. 4 and 5 with respect to rotor 79, each bushing 99 (having keyway 190) is inserted in central bore 185, with set screws 189 set at the interface of the rotor and bushing, to facilitate durable mounting of the rotor at shaft 21. The rotors may have different diameters and widths to provide varying amounts of mixing turbulence at each stage and within each stage at interstices 173 and 175 and passages 191.

By way of example, for an apparatus for mixing long-chain polymer with water in a four stage device with water being added at each stage and having a maximum out flow of the mixed materials, rotors having a radius of 4.97 inches and a width of 0.725 inches have been used. Each successive barrel section from the shortest at stage 63 to the longest at stage 69 are 1.125", 1.135", 1.145" and 1.155", thereby providing interstices at each successive stage of 0.080", 0,085", 0.090", and 0.095".

In use for mixing such polymer, neat polymer solution enters at a central part of chamber 71 through inlet 151. Water is likewise metered into chamber 71 at a controlled rate through inlet 149 in chamber wall 120 defined by end plate 29. The polymer and water thus injected come into contact with material contacting surface 177 of rotor 79. Due to the rotation of the rotor, groove 183 tends to pump the polymer and water toward the rotor's center, while the net fluid flow and centrifugal force tend to cause a radially outward net flow through interstice 173. The pumping action at interstice 175 is likewise opposite to fluid flow.

The spiral grooves have the advantage of allowing any polymer clumps which are not immediately diluted into the water to expand into the groove's space. A clump thus expanded into the groove, with the other surface of the clump forced against adjacent wall 120, will be forcibly drawn (pumped) to the rotor's center or to the outer part of the rotor to passage 191 by the combination of the groove, the rotor's rotation and net fluid flow, where it is retained. Any continuous, undiluted particles of polymer thus retained cannot continue through the mixing stage until more diluted.

Polymer adequately diluted in the first stage will follow a spiral path to passage 191, where it flows in a similar spiral path back toward the chamber's axis. Having a spiral groove engraved on one or both rotor material contacting surfaces 177 and 179 increases flow turbulence between the rotor surfaces and chamber walls (at the interstices), and improves the pumping function of each stage.

Polymer solution emerging from stage 63 through passage 165 is combined with additional water injected through passage 163 in stator member 121, and enters chamber 73 where a similar mixing function is repeated. This process is repeated at chambers 75 and 77, with the polymer/water solution concentration being reduced at each stage due to the water additions through passages 163.

After the solution passes rotor 85 in chamber 77, it passes through output passages 167 and 159 and finally through passage 157 and passage 161 to a holding tank or point of application.

What is claimed is:

1. An apparatus for mixing plural flowable materials comprising:

a rotatable member having a selected surface complexity defined at at least one material contacting surface thereof;

driving means connected with said rotatable member to rotate said rotatable member;

a housing defining a chamber having said rotatable member rotatably mounted therein and including a static member positioned in a spaced relationship relative to said rotatable member along its entire said material contacting surface including said surface complexity so that an interstice is defined between said static member and said entire said one material contacting surface of said rotatable member;

flowable material inlet means through said housing for introducing flowable materials into said housing and thereby said interstice between said static member of said housing and said entire said one material contacting surface of said rotatable member; and outlet means connected to said housing for accommodating flow of mixed flowable materials from said chamber.

2. The apparatus of claim 1 wherein said surface complexity of said one material contacting surface of said rotatable member is defined by surface portions with different relative elevations at a common boundary area of said surface portions.

3. The apparatus of claim 1 wherein the flowable materials include first and second flowable materials having different viscosities, and wherein said surface complexity of said one material contacting surface of said rotatable member includes a channel formed in said one material contacting surface.

4. The apparatus of claim 3 wherein said channel in said one material contacting surface of said rotatable member is a spiralling channel radiating from a central part of said one material contacting surface of said rotatable member to an outer edge thereof.

5. The apparatus of claim 1 wherein said rotatable member has a second material contacting surface having a selected surface complexity defined thereat.

6. The apparatus of claim 1 wherein said housing includes a second static member positioned so that a second interstice is defined between a second material contacting surface of said of said rotatable member and said second static member, said outlet means being positioned through said housing so that said mixed flowable materials flow from said chamber after passage of the flowable materials through said interstices.

7. An apparatus for mixing plural flowable materials comprising:

a housing defining a chamber having first and second spaced chamber walls and a peripheral wall having a selected length defined between said first and second chamber walls adjacent to an outer part of said first and second chamber walls, said first chamber wall having inlet means at a central part thereof for introducing flowable materials into said chamber, and said second chamber wall having an outlet adjacent to a central part thereof for accommodating flow of flowable materials from said chamber;

a rotatable shaft mounted through said chamber; and a rotatable member mounted on said shaft and in said chamber for rotation between said first and second chamber walls thereof, said rotatable member having first and second material contacting surfaces and a width between said surfaces marginally smaller than said length of said peripheral wall of said chamber so that first and second interstices are defined between said first surface and said first chamber wall and said second surface and said second chamber wall, respectively, said interstices being in communication through a passage defined between said peripheral wall and an outer edge of said rotatable member for movement of the flowable materials therebetween.

8. The apparatus of claim 7 wherein said inlet means of said first chamber wall includes first and second inlets for introducing different flowable materials into said chamber.

9. The apparatus of claim 7 wherein at least one of said first and second material contacting surfaces of said rotatable member has a selected surface complexity defined thereat.

10. The apparatus of claim 9 wherein said surface complexity at said one of said material contacting surfaces of said rotatable member is a spiralling channel radiating from a central part of said one of said material contacting surfaces toward said outer edge of said rotatable member.

11. The apparatus of claim 10 wherein said spiralling channel is formed so that a plurality of adjacent channel segments are defined on said one of said material contacting surfaces by multiple turns of said spiralling channel.

12. The apparatus of claim 10 wherein said surface complexity is defined at both of said first and second material contacting surfaces of said rotatable member.

13. An apparatus for mixing plural flowable materials comprising:

a housing defining multiple adjacent chambers, each chamber being defined by first and second spaced chamber walls and a peripheral wall having a selected length defined between said first and second chamber walls adjacent to an outer part of said first and second chamber walls, said first chamber wall of each chamber having inlet means for introducing flowable materials into the related said chamber, and said second chamber wall of each chamber having an outlet for accommodating flow of flowable materials from the related said chamber;

a plurality of rotatable members each mounted in a different one of said chambers for rotation between said first and second chamber walls thereof, said rotatable members each having first and second material contacting surfaces and a width between said surfaces marginally smaller than said length of said peripheral wall of said chamber in which a rotatable member is mounted so that first and second interstices are defined between said first surface and said first chamber wall and said second surface and said second chamber wall, respectively, in each said chamber, said first and second interstices being in communication in each said chamber through a passage defined between said peripheral wall and an outer edge of said rotatable member in each said chamber for movement of the flowable materials therebetween; and driving means connected with said rotatable members for rotating said rotatable members in said chambers.

14. The apparatus of claim 13 wherein said chambers are arranged so that said second chamber wall of one of said chambers and said first chamber wall of another of said chambers are defined by a plate member with said outlet of said second chamber wall of said one of said chambers and said inlet means of said first chamber wall of said another of said chambers being connected by a first passageway through said plate member, said housing having a second passageway formed therein for passage of flowable materials therethrough to one of said first passageway and said another of said chambers.

15. The apparatus of claim 14 wherein at least one of said first and second interstices of said another of said chambers is larger than said first and second interstices of said one of said chambers.

16. The apparatus of claim 13 wherein said housing includes first and second end plates adjacent to different ones of said chambers, said first end plate defining said first chamber wall of one of said chambers and said second end plate defining said second chamber wall of another of said chambers.

17. The apparatus of claim 16 wherein said multiple adjacent chambers include at least a third chamber with said outlet of said second chamber wall of said one of said chambers being connected with said inlet means of said first chamber wall of said third chamber, and with said outlet of said second chamber wall of said third chamber being connected with said inlet means of said first chamber wall of said another of said chambers.

18. The apparatus of claim 17 wherein said inlet means and outlets are adjacent to a central part of said first and second, respectively, chamber walls of said chambers.

19. The apparatus of claim 13 wherein said rotatable members are generally disc shaped and wherein at least one of said material contacting surfaces of each of said rotatable members has a selected surface complexity defined thereat.

20. The apparatus of claim 19 wherein said surface complexity at said one of said material contacting surfaces of said rotatable members is a spiralling channel radiating from a central part of said one of said material contacting surfaces toward said outer edge of said rotatable member.

* * * * *